United States Patent [19]

Arney

[11] Patent Number: 4,576,237

[45] Date of Patent: Mar. 18, 1986

[54] FIRE FIGHTING BUCKET ASSEMBLY FOR AIRCRAFT

[76] Inventor: Donald B. Arney, Suite 1001, 2191 W. 39th Ave., Vancouver, British Columbia, Canada, V6M 1T7

[21] Appl. No.: 631,083

[22] Filed: Jul. 16, 1984

Related U.S. Application Data

[63] Continuation-in-part of Ser. No. 374,790, May 4, 1982, Pat. No. 4,474,245.

[30] Foreign Application Priority Data

Aug. 31, 1983 [GB] United Kingdom ..... 8323286

[51] Int. Cl.[4] ..... A62C 28/00

[52] U.S. Cl. ..... 169/53; 294/68.21

[58] Field of Search ..... 169/34, 53; 294/69 R, 294/68; 239/171; 150/48; 383/2, 37, 72, 22-24

[56] References Cited

U.S. PATENT DOCUMENTS 2,080,252 5/1937 Cook ..... 383/2

3,661,211 5/1972 Powers ..... 169/53

*Primary Examiner*—Andres Kashnikow

*Assistant Examiner*—Scott D. Malpede

*Attorney, Agent, or Firm*—Carver & Co.

[57] ABSTRACT

A collapsible fire fighting bucket to be suspended from an aircraft and to be filled from an open body of water. The bucket has two means for adjusting the capacity thereof to accomodate load carrying capacity of the aircraft. One means includes sidewall stiffening means in the bucket sidewall which bulge outwardly under load. The second means includes an adjusting means around the side wall for adjustably restricting the circumference thereof and thereby reducing the capacity of the bucket. A bucket assembly comprising a main bucket and a booster bucket is used for filling from shallow water. The booster bucket empties into the main bucket on lifting to give the main bucket a better fill.

23 Claims, 10 Drawing Figures

FIG 5
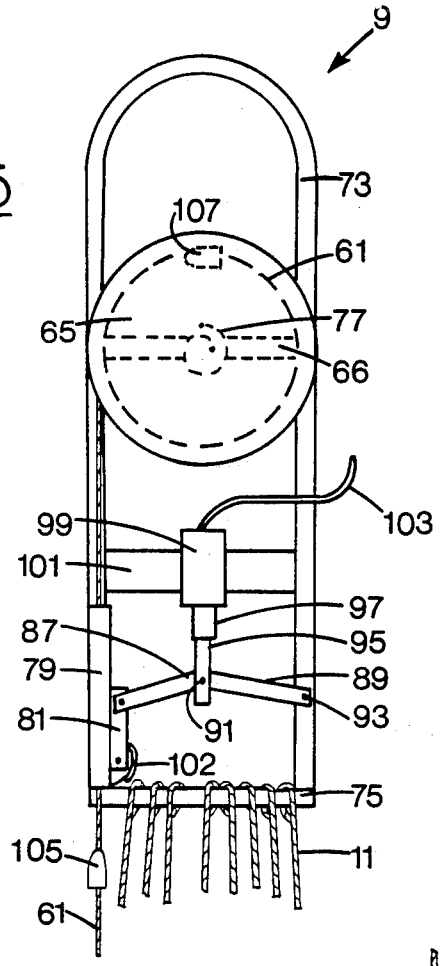
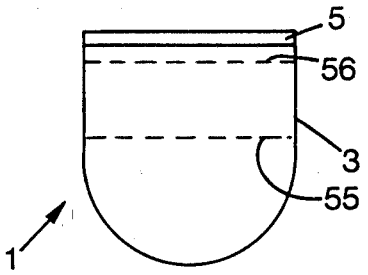
FIG 7
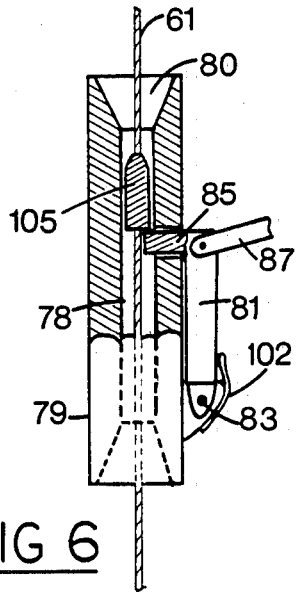
FIG 6

FIRE FIGHTING BUCKET ASSEMBLY FOR AIRCRAFT

CROSS REFERENCES TO RELATED APPLICATIONS

This is a continuation-in-part of my copending application Ser. No. 06/374,790 filed May 4, 1982 now U.S. Pat. NO. 4,474,245.

BACKGROUND OF THE INVENTION

1. Field of the Invention

The invention relates to a fire fighting bucket assembly to be suspended from an aircraft and to be filled from an open body of water, e.g. from a lake.

2. Prior Art

A collapsible fire fighting bucket adapted to be suspended from a helicopter and to be filled by immersion into a lake is known from U.S. Pat. No. 3,661,211 to Powers. This bucket is formed of a collapsible external frame which supports the flexible side walls. The frame includes a rigid upper peripheral frame member connected to a rigid circular bottom member by means of four rigid, normally upright, but collapsible braces. The watr is released from the bucket by opening two doors in the bottom by means of a ram operated by pressurized fluid. Slots or spill ports, closable by zippers, are provided at a certain height in the flexible side wall for limiting the capacity of the bucket and thereby adapting it to the lifting capabilities of the aircraft. This known bucket is rather bulky in its collapsed state, and the rigid, flat bottom with its water release mechanism makes it fairly heavy and expensive to manufacture.

U.S. Pat. No. 3,572,441 to Nodegi describes a liquid discharge tank for fire fighting in the shape of a flexible bag, closed at the top and having a snout-like extension at its bottom. The extension can be pulled into the bag by means of a rope attached to its lower end. The rope is guided through the central opening of a cylinder, which closes the upper end of the bag and has a hanging bar adapted to be connected to the underside of a helicopter. A combined solenoid and hydraulically operated locking mechanism locks a stopper on the rope inside the cylinder to keep the extension in its withdrawn position when the bag is full. When the mechanism is released, the extension is forced out of the bag under the pressure of the liquid, thereby releasing the liquid onto the fire. When the bag is empty, the rope and with it the extension is pulled up again.

The discharge port of the extension must be positioned above the liquid level inside the bag in order to prevent leakage. Because of this, the extension has a considerable length and can get twisted when the rope is released, so that the liquid cannot be dumped from the bag. Twisting can also make it impossible to withdraw the extension into the bag. This bag must be filled through the extension and cannot be filled by dumping it into a lake, which limits its application because a filling station is required. Valuable time can be lost by this way of operation, and the fighting of forest fires, especially in remote areas, is not practical with this device.

SUMMARY OF THE INVENTION

The disadvantages of the prior art are reduced by providing a collapsible fire fighting bucket that is simple, lightweight and rugged in construction, that can easily be folded and assembled, and requires minimal space on the aircraft when it is flown to the location of the fire. The bucket can be filled quickly and easily by dumping it into a lake and pulling it up again. The invention also provides a bucket that can have two capacity adjusting means to adjust its capacity to the load carrying capabilities of the aircraft without the use of spill ports in its side wall.

A collapsible fire fighting bucket according to the invention, has means for suspending from an aircraft and preferably is filled from an open body of water. The invention has an open bucket having an upper rim defining an upper opening, a side wall made of pliable material, a bottom, upper rim stiffening means and a dump valve in the bottom. The upper rim stiffening means cooperate with the upper rim to maintain the upper opening at an essentially constant size so that the bucket remains open while operative. The invention has bucket capacity adjusting means cooperating with the side wall for adjustably varying side wall circumference remote from the rim so as to vary capacity of the bucket, with a negligible change in the size of the opening. The water within the bucket extends essentially all of the side wall axially so that there is a negligible change in length of the bucket as the capacity of the bucket is varied. The first capacity adjusting means includes side wall stiffening means dimensioned such that the side wall remains essentially straight while submerged under a low pulling force, but will bulge outwards while submerged under a higher pulling force so as to adapt the capacity of the bucket to the load carrying capability of the aircraft.

While this feature works well in practice, it is nevertheless desirable under certain conditions to adjustably limit the capacity of the bucket independently of the pulling force of the helicopter. This is desirable when a big bucket is used with a less powerful helicopter. The pilot then adjusts the bucket to a certain capacity corresponding to the load carrying capability of his helicopter before starting the fire fighting operation. Thus he is no longer required to pull the bucket skillfully out of the water at a certain speed at every refill operation. This can speed up the whole operation considerably. Furthermore it is sometimes desirable to limit the capacity of the bucket even more than is possible by a very slow upwards pull. These problems are reduced by a fire fighting bucket according to the invention comprising an open bucket body made of pliable material and having an upper rim, a side wall, and a bottom; a dump valve in the bottom; upper rim stiffening means; means for suspending the bucket from the aircraft; and adjusting means around the side wall for restricting the circumference thereof for adjusting the capacity of the bucket.

Occasionally a fire fighting bucket has to be filled from an open body of water that is so shallow that the bucket is only partly submerged when hitting the bed of the lake etc. Under such circumstances the bucket will only be partly filled, and the fire fighting operation will be seriously impaired and will be very uneconomical because of more frequent refill operations necessary. These problems are reduced by providing a collapsible fire fighting bucket assembly according to the invention which includes a main bucket having an upper rim, a side wall, and a bottom; a dump valve in the bottom; upper rim stiffening means; suspending means for suspending the main bucket from the aircraft; and a booster bucket having an upper rim, a side wall, a bottom, and an outlet in the bottom, the booster bucket being connected to the suspending means above the main bucket, so that the booster bucket empties into the main bucket, when the bucket assembly is pulled out of the water.

Examples of devices according to the invention will now be described, with reference to the accompanying drawings.

DESCRIPTION OF THE DRAWINGS

FIG. 5 is a simplified diagrammatic side elevation of the connector for suspending the bucket from an aircraft;

FIG. 6 is a side elevation, partly in fragmented longitudinal cross section, of the guide tube and locking mechanism of the connector;

FIG. 7 is a simplified diagrammatic side elevation of the bucket of FIG. 1 showing its approximate shape when filled;

DETAILED DISCLOSURE

FIGS. 1–4

Figure 1:
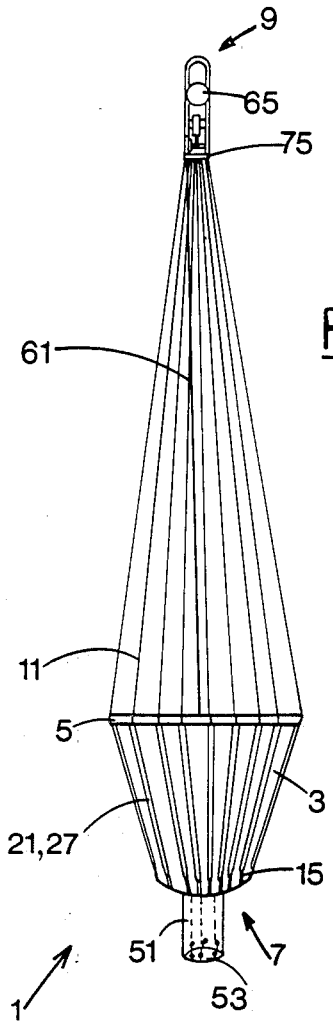
FIG. 1 is a simplified diagrammatic side elevation of a bucket according to the invention.

A bucket body 1 according to the invention is made of a pliable material, e.g. a vinyl impregnated woven synthetic fabric. It has a side wall 3, an upper rim 5 and a bottom 7. The bucket body 1 is suspended from an aircraft by a plurality of ropes or wires 11 and belts 15. Each rope is connected with the upper end to a crossbar 75 of a connector 9, and with the lower end to the upper end of a belt 15, the lower end of which is anchored on a circumferential rope 17, which supports the bottom 7 of the bucket. The ropes 11 and 17 and the belts 15 are also referred to as flexible tension links.

The belts 15 are received in open ended belt pockets 19, which are arranged around the side wall 3 of the bucket. The belt pockets 19 are formed by the side wall 3 and first longitudinal fabric cover strips 21 connected to the side wall by stitching or welding. Stiffener battens 23, e.g. made of fiberglass, are received in closed stiffener pockets 25 formed by the first cover strips 21 and second longitudinal fabric cover strips 27, stitched to the first cover strip 21 and narrower than these. The battens 23 provide a plurality of peripherally spaced apart ribs connected to the sidewall and extending longitudinally between the upper rim and the bottom. Upper rim stiffener battens 29 are received in upper rim pockets 31. For ease of storage of the battens 29, preferably three overlapping battens 29 are used, fitted in three overlapping rim pockets.

An upper ballast pocket 33 closable by a zipper 35 and a lower ballast pocket 37 closable by a zipper 39 are positioned on one side only on the inside of the side wall 3 of the bucket. These pockets can be filled with ballast, e.g. chains 41 and 43.

Figure 4:
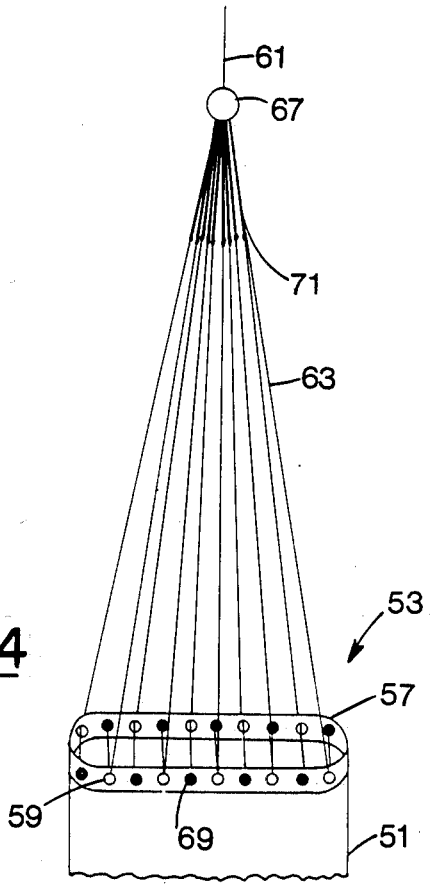
FIG. 4 is a simplified diagrammatic perspective view showing the discharge portion of the tubular extension of the bucket and the supporting means.
Figure 2:
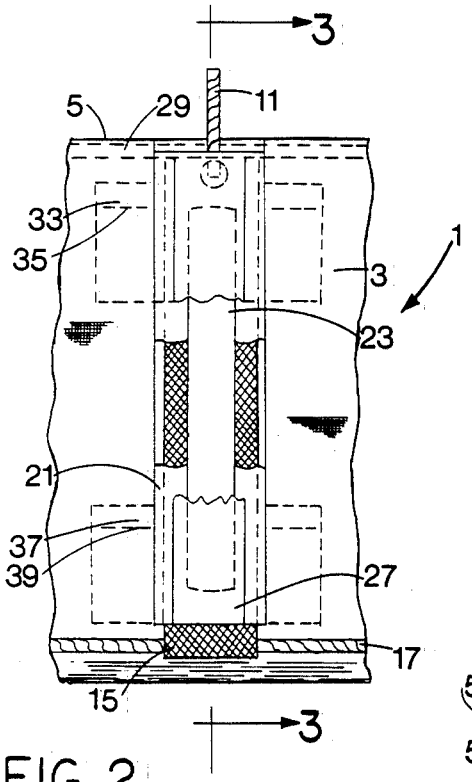
FIG. 2 is a simplified fragmented side elevation of part of the side wall of the bucket of FIG. 1.
Figure 3:
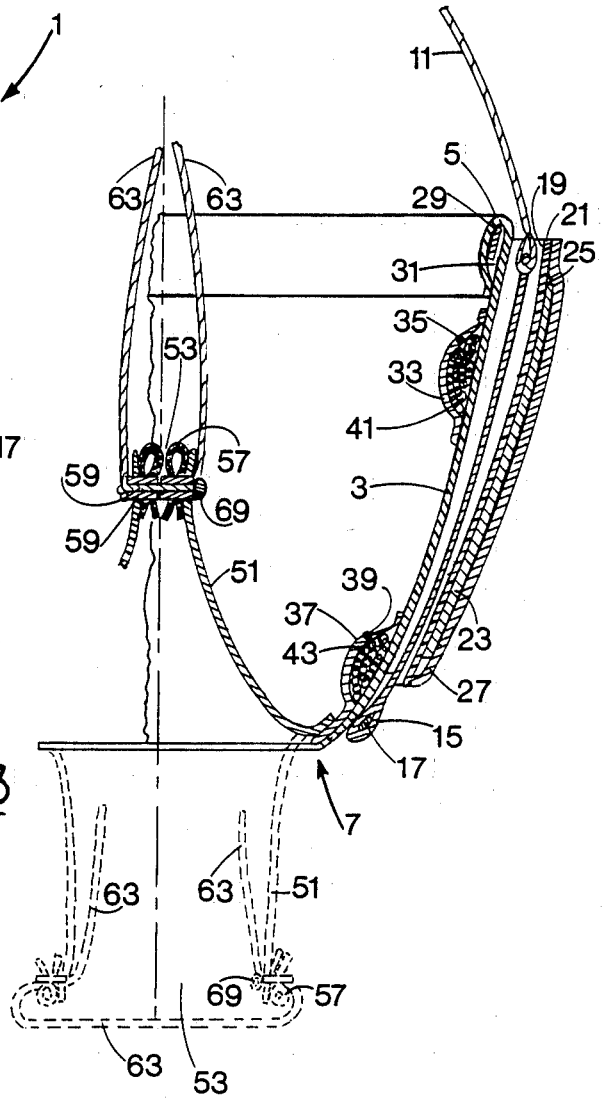
FIG. 3 is a cross section of the bucket of FIG. 1 along the line 3—3 of FIG. 2.

A tubular extension 51 made of water impervious fabric is connected to the side wall 3 at the bottom 7 of the bucket. This tubular extension is shown in FIG. 1 and FIG. 3 (in broken lines) in its extended position for dumping the water from the bucket through the open discharge port 53, and in FIG. 3 (in full lines) in its withdrawn position with the discharge port closed for holding the water. In FIGS. 1 and 3, the bucket is shown empty and consequently the side wall is essentially straight. Partly or completely filled, the side wall bulges outwards as shown in FIG. 4 and for reasons to be explained below.

Around the discharge port 53 a sealing lip 57 is provided for sealing the discharge port in its withdrawn position, where it is below the water level in the bucket. The sealing lip is made of a resilient material, e.g. a synthetic rubber named Neoprene. The sealing lip 57 is fastened to the fabric of the tubular extension 51 by means of a plurality of grommets 59. The tubular extension is supported in its withdrawn position by a rope 61 branching into a plurality o f ropes 63. The rope 61 is wound on a reel 65 of the connector 9, which connects the arrangement to a helicopter. The lower ends of the ropes 63 are slidably penetrating in an alternate fashion grommets on one sealing lip section and are terminated by plastic balls 69 behind grommets on the opposite sealing lip section. The terminations by ball 69 alternate along the sealing lip walls the penetrating ends of the ropes 63 as shown in FIG. 4.

FIGS. 5 and 6

The connector 9 for suspending the bucket from the helicopter comprises a hanging bar 73 having a crossbar 75 to which the ropes or wires 11 are attached. A reel 65 is rotatably connected to a crossbar 66 and biased by a recoil spring 77 cooperating with the reel 65 for winding up the rope 61 for withdrawing the tubular extension 51 into the bucket. The rope passes through the inner bore 78 of a guide tube 79 connected to the hanging bar 73. A latch 81 is pivotally linked to the guide tube at the pivot point 83. A tongue 85 of the latch 81 extends through an opening into the guide tube 79. A first horizontal lever 87 is pivotally linked with one end to the latch 81 and pivotally linked with its other end to a second horizontal lever 89 by a pin 91. The other end of the second horizontal lever 89 is pivotally connected to the hanging bar 73 at a pivot point 93. A vertical drawbar 95 is connected with one end to the pin 91 and with its other end to the plunger 97 of a solenoid 99, which is connected to a crossbar 101 of the hanging bar 73. A leaf spring 102 holds the latch 81 in its rest position as shown in FIG. 6. A cable 103 connects the solenoid 99 to an electric operating system (not shown) on the helicopter. Two bullet-shaped stoppers 105 and 107 are fastened concentrically on the rope 61 with their rounded head portions pointing at each other. To facilitate the entry of the stoppers into the guide tube 79, the inner bore 78 tapers outwardly to wider entrance openings 80 on both sides of the guide tube. The distance on the rope between the stoppers corresponds approximately to the distance between the discharge port 53 in its withdrawn or extended position respectively.

FIG. 7

FIG. 7 shows the approximate shape of the bucket when filled partly to a lower water level 55 or when filled to capacity to a high water level 56 in the manner explained below.

OPERATION

The bucket can be transported in the helicopter in its collapsed state like a folded umbrella. For assembling the bucket, the upper rim stiffener battens 29 are pushed into the upper rim pockets 31 to give the upper rim a semi-rigid circular shape. The tubular extension 51 is withdrawn into the bucket body 1 under the force of a recoil spring, which rotates the reel 65 until the rope 61 is wound up and keeps the tubular extension under tension, assisted by a solenoid operated locking and releasing mechanism 99. The bucket is now suspended from the helicopter and is ready for filling. In FIG. 6 the rope is shown in operation during the winding up procedure where the stopper has not yet passed the guide tube 79.

The helicopter flies with the empty bucket to a lake, and the empty bucket will angle back during forward flight. The one-sided ballast formed by the chains 41 and 43 prevents the bucket from spinning on the suspending wires 11. The helicopter than hovers over the lake, dumping the bucket into the water and the ballast allows the bucket to submerge quickly for filling. When the helicopter pulls the filled bucket out of the water, the weight of the water on the tubular extension 51 keeps the ropes 63 and 61 under tension and the sealing lips 57 closed as follows. The stopper 105 is locked in position by the latch 81 as shown in FIG. 6. The tension in the ropes 63, averaged by the resiliency of the strings 71, brings the sealing lip 57 into sealing abutment, which is necessary to prevent water leakage from the discharge port 53, which is not positioned below the water level in the bucket. It is important to form the tubular extension short and wide as otherwise there is the danger that the tubular extension will become twisted and will then malfunction either while extending it when dumping the water or while withdrawing it, when the bucket is empty. Also the water must be dumped as quickly as possible to prevent premature evaporation over the fire. For this reason, the tubular extension is preferably formed so short that the discharge port 53 remains in the water in the full bucket. This feature necessitates a good seal of the discharge port.

Apart from generally supporing the side wall 3, the stiffener battens 23 have the further function of permitting adjustment of the capacity of the bucket to a predetermined amount. The load carrying capability of a helicopter depends greatly on the environmental conditions like altitude and temperature, which determine the air density. Generally, the load carrying capability decreases with increasing altitude and temperature, i.e. with decreasing air density. The stiffener battens 23 are dimensioned such that they remain essentially straight under water, thus keeping the side wall essentially straight when the bucket is slowly pulled out of the water by a helicopter operating at relatively low power. When the bucket has beem pulled out of the lake, the stiffener battens bulge outwards under the water pressure so that the bucket assumes a shape as shown approximately in FIG. 7. Due to the relatively slow pull, the bucket has a frusto-conical shape under water and therefore a limited capacity. The bucket will thus be only partly filled to a lower water level 55, after having been pulled out of the water.

When, however, the bucket is pulled out of the water with greater speed by a helicopter operating at relatively high power, the side wall of the bucket will bulge outwards while still under the lake surface, allowing maximum filling capacity. The bucket will then be filled to a high water level 56, after having been pulled out of the water. Thus by controlling the speed of pulling the bucket out of the water, the filling capacity can be easily controlled which avoids the extra expense, handling and complications of spill ports in the side wall of the bucket.

The full bucket is now flown to the location of the fire. For dumping the water, the pilot activates the solenoid 99 for a short time. Thereby the plunger 97 lifts the levers 87 and 89 upwards, pulling the latch 81 away from the guide tube 79 against the force of the leaf spring 102, so that the tongue 85 releases the stopper 105. This brings the tubular extension 51 into its extended position under the pressure of the water, as shown in broken lines in FIG. 3. The rope 61 unwinds from the reel 65, rotating the reel and winding up the recoil spring 77. The second stopper 107 passes through the guide tube 79 pushing monentarily away the tongue 85 with its rounded head portion, while the solenoid is already deactivated. When the tubular extension 51 is fully extended and the water is rushing through the discharge port, the stopper 107 is located below the tongue 85 of the latch 81 and as soon as the torquing force of the recoil spring 77 exerted on the reel 65 is greater than the downwards pushing force of the remainder of the water, the increasing upwards pull in the rope 61 is stopped by the tongue 85 of the latch 81 locking the stopper 107 in position with its flat and engaging the tongue 85. The allows the bucket to be emptied completely.

The pilot now again activates the solenoid for a short time, the tongue 85 is retracted, so that the second stopper 107 is released and the rope 61 is wound up on the reel 65 under the torquing force of the recoil spring 77. The latch 81 snaps back under the pressure of the leaf spring 102 and allows the first stopper 105 to pas with its rounded end pushing back the tongue 85 momentarily. This brings the tubular extension 51 back into its withdrawn position and the bucket is ready to be filled again.

ALTERNATIVES AND EQUIVALENTS

FIG. 8

Figure 8:
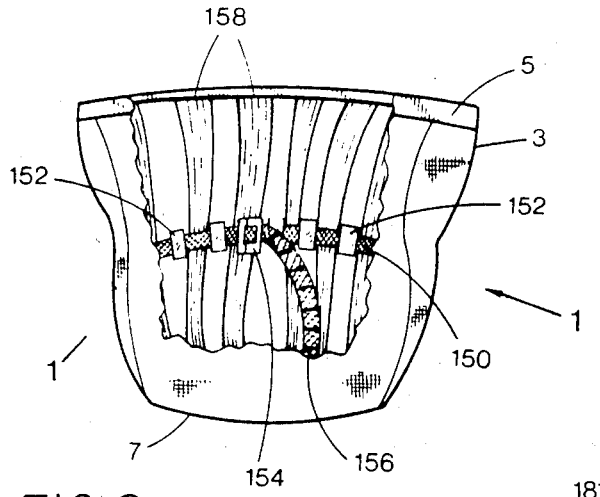
FIG. 8 is a simplified diagrammatic side elevation of a bucket according to the invention with the side wall shown partly fragmented.

FIG. 8 shows a bucket according to the invention with the front portion of thbe side wall fragmented in order to show part of the inside of the rear portion of the sidewall. The suspending means and the dump valve are not shown for clarity reasons. Similar parts have the same reference numbers as used in FIGS. 1 through 7. This embodiment also incorporates an alternative bucket capacity adjusting means as follows.

The bucket comprises a bucket body 1 having a side wall 3, an upper rim 5, and a bottom 7. Around the inside of the side wall 3 bucket capacity adjusting means are provided for adjustably restricting the circumference of the side wall for adjusting the capacity of the buckets. The adjusting means comprise a circumferential flexible tension link in the form of a cinch belt 150 slidably received in belt loops severally designated 152, which are connected inside the side wall 3 by stitching or bolting. The ends of the cinch belt 150 are connected by a clamping member in the form of a buckle or a pair of so called D-rings 154, and by operating the cinch belt and the buckle, the effective circumferential length of the cinch belt can be adjusted as desired. Calibration markings severally designated 156 are provided on the cinch belt to allow easy and fast adjustment for the desired load capacity. In FIG. 5 the cinch belt 150 is tightened to such an extent that the volume of the bucket body is restricted and creases 158 are formed in the side wall 3. In a practical design the full capacity of a bucket was approximately 1600 liters giving a gross weight of approximately 1650 kg. Pulling this bucket out of the water at slow speed without using the cinch belt but using side wall stiffener battens 23 (not shown in FIG. 8) to control the shape of the bucket, the gross weight could be reduced to approximately 1200 kg. With the cinch belt used additionally to the side wall stiffeners, the gross weight of the bucket could be reduced to approximately 900 kg regardless of the speed by which the bucket was pulled out of the water.

In the two embodiments of FIGS. 1 through 7 and 8 through 10, the upper rim defines an upper opening, and the upper rim stiffening means cooperate with the upper rim to maintain the upper opening at an essentially constant size so that the bucket remains open while operative. Also, in both embodiments, the capacity adjusting means cooperates with the side wall for adjustably varying side wall circumference remote from the rim so as to vary the capacity of the bucket with a negligible change in size of the opening. The water within the bucket extends essentially all of the side wall axially for all capacities of the bucket, so that there is a negligible change in length of the bucket as the capacity of the bucket is varied. Although the capacity adjusting means are preferably used with a collapsible bucket having side wall stiffener battens, it should be clearly understood that the adjusting means can also be used with collapsible buckets having no side wall stiffener battens. Also the cinch belt could be on the outside of the side wall 3, where it could, however, be entangled in obstacles or the ground or be subjected to chafing. Therefore the protected inside location is preferred.

Figure 10:
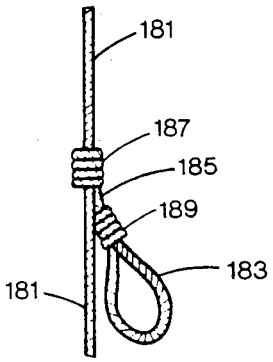
FIG. 10 is a simplified detail drawing of suspending means for the booster bucket.
Figure 9:
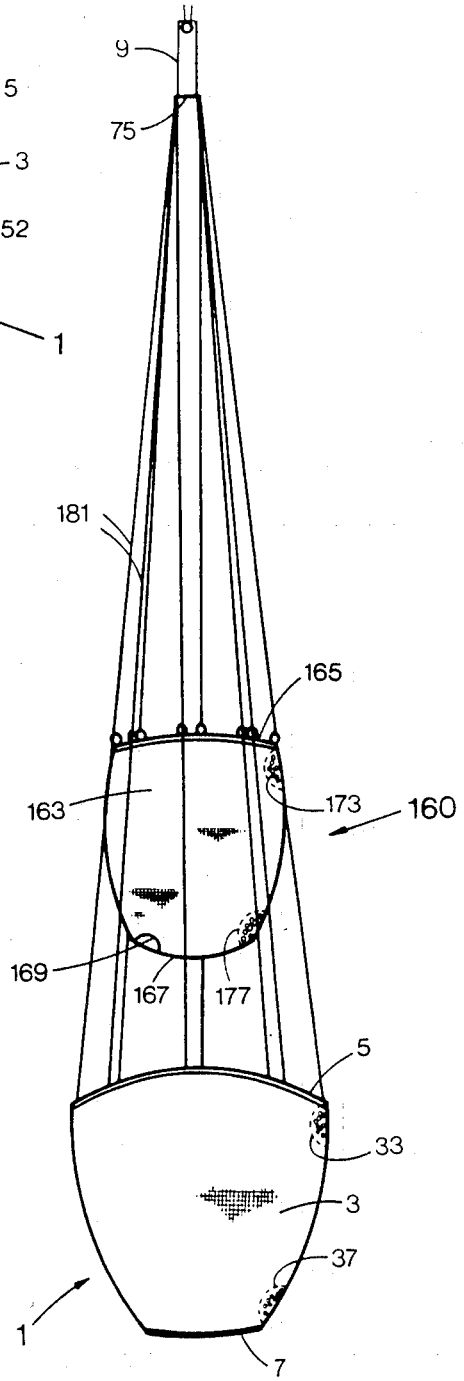
FIG. 9 is a simplified diagrammatic side elevation showing a bucket assembly according to the invention with a main bucket and a booster bucket.

FIGS. 9 and 10

FIG. 9 shows a bucket assembly according to the invention, which assembly is used for filling from a shallow open body of water, such as a shallow pond. Identical reference numbers from preceding figures are used for similar parts. The bucket assembly comprises a main bucket 1 and a booster bucket 160 having a side wall 163, an upper rim 165, and a bottom 167. The booster bucket 160 is essentially built like the main bucket 1 with upper rim stiffener battens and side wall stiffener battens. However instead of a dump valve in the form of the tubular extension 51 (not shown in FIG. 9) of the main backet, the booster bucket 160 has only an open outlet 169 in the bottom 167. This outlet is located off centre and diametrically opposite of that part of the side wall 163 that has an upper ballast pocket 173 and a lower ballast pocket 177 to be filled with ballast, like e.g. lead shot.

It should be noted that the lower ballast need not be off center as shown in FIG. 9. The lower ballast can be arranged symmetrically relative to the bottom of the bucket. The circumferential rope 17 (FIG. 2 and 3) e.g. can be replaced by a chain serving as ballast means for the main bucket. The lower ballast can also be located centrally on the bottom of the booster bucket.

The booster bucket 160 is suspended above the main bucket 1 and is connected to suspending wires or flexible tension links severally designated 181 by means of shackles engaging grommets along the upper rim 165 and thimbles 183, which are connected to the suspending wires 181 by intermediate wires or flexible tension link 185 and so called nicopress fittings 187 and 189, or by other suitable means. The booster bucket 160 is suspended above the main bucket in such a way, that the ballast pockets 33, 37, 173, 177 are suspended one pair above the other pair as shown in FIG. 9. The rope 61 operating the dump valve of the main bucket 1 passes through the outlet 169; the rope 61 is not shown in FIG. 9.

When the helicopter dumps the bucket assembly of FIG. 9 into a shallow body of water, both buckets are probably only partly submerged. When the buckets are pulled from the water, the booster bucket 160, rising a moment earlier, empties into the main bucket 1, which just starts to rise. The booster bucket thus gives the main bucket a better fill, and the location of the ballast relative to the off center outlet 169 of the booster bucket 160 ensures that the water pouring from the booster bucket flows into the main bucket during the starting phase of the lifting operation. The requirements of water tightness for the booster bucket are not stringent, as the booster bucket has to hold the water only for a few seconds.

I claim:

1. A collapsible fire fighting bucket to be suspended from an aircraft and to be filled from an open body of water, the bucket having suspending means for suspending the bucket from the aircraft, a dump valve and associated valve operating means, the bucket being characterized by:

(a) an open bucket body made of pliable material and having an upper rim defining an upper opening, a side wall, and a bottom, (b) upper rim stiffening means cooperating with the upper rim to maintain the upper opening at an essentially constant size so that the bucket remains open while operative, (c) capacity adjusting means cooperating with the side wall for adjustably varying side wall circumference remote from the rim, so as to vary the capacity of the bucket with a negligible change in size of the opening, water within the bucket extending essentially all of the side wall axially for all capacities of the bucket so that there is a negligible change in length of the bucket as the capacity of the bucket is varied.

2. A bucket as claimed in claim 1 wherein the bucket capacity adjusting means includes stiffening means dimensioned such that the side wall remains essentially straight while submerged in water under a low pulling force, but will bulge resiliently outwardly while submerged under a higher pulling force, so as to adapt the capacity of the bucket to load carrying capabilities of the aircraft.

3. A bucket as claimed in claim 2, wherein the side wall stiffening means include a plurality of ribs cooperating with the side wall and extending longitudinally between the upper rim and the bottom of the bucket, the ribs being spaced apart peripherally around the side wall of the bucket.

4. A bucket as claimed in claim 3 further characterized by:

(a) a plurality of longitudinally extending pockets cooperating with the side wall of the bucket, (b) the ribs being received in the pockets so that the pockets restrain the ribs against lateral movement.

5. A bucket as claimed in claim 1, wherein the bucket capacity adjusting means includes:

(a) a circumferential flexible tension link extending peripherally around and cooperating with the side wall of the bucket, (b) a clamping member cooperating with the circumferential flexible tension link for adjusting effective length of the flexible tension link.

6. A bucket as claimed in claim 5 further including:

(a) a plurality of belt loops disposed peripherally around the side wall of the bucket, (b) the circumferential flexible tension link is a cinch belt which is slidably received in the belt loops, (c) the clamping member is a buckle which cooperates with the link to adjust effective length of the link.

7. A bucket as claimed in claim 6, wherein the cinch belt is positioned within the bucket so as to prevent interference with obstructions outside the bucket.

8. A bucket as claimed in claim 7, wherein the cinch belt has calibration markings to permit determination of capacity of the bucket based on position of the buckle relative to the calibration markings.

9. A bucket as claimed in claim 1 in which the suspending means includes:

(a) a connector adapted to be connected to the aircraft, (b) a plurality of first flexible tension links extending between the bucket and the connector.

10. A bucket as claimed in claim 9 in which the suspending means is further characterized by:

(a) a second flexible tension link extending circumferentially around and supporting the bottom of the bucket, (b) the first flexible tension links extending between the connector and the second flexible tension link, and also cooperating with the side wall of the bucket to maintain a peripherally spaced relationship around the bucket.

11. A bucket as claimed in claim 9 wherein the first flexible tension links each have a section formed by a belt which cooperates with the side wall of the bucket.

12. A bucket as claimed in claim 10, further characterized by:

(a) a plurality of open-ended, peripherally spaced-apart, longitudinally extending pockets provided on the side wall of the bucket, (b) the first flexible tension links being received in respective longitudinal pockets and cooperating with the second flexible tension link.

13. A bucket as claimed in claim 1 further characterized by:

(a) the upper rim of the bucket having a plurality of circumferentially disposed pockets, (b) a plurality of stiffeners being overlappingly received in the circumferentially disposed pockets so as to maintain the bucket open.

14. A bucket as claimed in claim 1, further including:

(a) ballast means positioned adjacent the upper rim, and also adjacent one side of the bottom of the bucket for achieving fast submersion during filling.

15. A bucket as claimed in claim 14, further including:

(a) closable pockets secured to the bucket to receive the ballast means.

16. A collapsible fire fighting bucket assembly to be suspended from an aircraft and to be filled from an open body of water, the assembly being characterized by:

(a) a main bucket having an upper rim, a side wall, and a bottom;

(b) a dump valve in the bottom;

(c) upper rim stiffening means;

(d) suspending means for suspending the main bucket from the aircraft;

(e) a booster bucket having an upper rim, a side wall, a bottom, and an outlet in the bottom, the booster bucket being connected to the suspending means above the main bucket, so that the booster bucket empties into the main bucket, when the bucket assembly is pulled out of the water.

17. A bucket assembly as claimed in claim 16, wherein the suspending means comprise a connector adapted to be connected to the aircraft and a plurality of flexible tension links connected between the bucket and the connector.

18. A bucket assembly as claimed in claim 17, wherein the booster bucket is connected to the flexible tension links.

19. A bucket assembly as claimed in claim 16, further comprising ballast means positioned adjacent the upper rim on one side of the main bucket and a correlated side of the booster bucket for achieving fast submersion during the filling procedure.

20. A bucket assembly as claimed in claim 19, wherein the ballast is received in closable pockets.

21. A bucket assembly as claimed in claim 19, wherein the outlet in the bottom of the booster bucket is located off center and diametrically opposite the ballasted portion of the side wall for achieving optimum transfer of water from the booster bucket into the main bucket when filling from a shallow body of water.

22. A bucket assembly as claimed in claim 16, wherein the main bucket and the booster bucket are made of pliable material.

23. A bucket assembly as claimed in claim 16, further comprising ballast means positioned adjacent the bottom of the main bucket and the booster bucket for achieving fast submersion during the filling procedure.

* * * * *